United States Patent [19]

Kolonia

[11] 4,418,732

[45] Dec. 6, 1983

[54] HAND TOOL AND A CORE REINFORCED MOLDED SYNTHETIC MATERIAL HANDLE THEREFOR

[76] Inventor: Robert A. Kolonia, R.D. #3, Agnes Rd., Box 318, Milford, N.J. 08848

[21] Appl. No.: 190,539

[22] Filed: Sep. 24, 1980

[51] Int. Cl.[3] ..... B26B 23/00

[52] U.S. Cl. ..... 145/2 R; 145/61 C; 145/61 H

[58] Field of Search ..... 145/2 R, 61 R, 61 C, 145/61 F, 61 H, 61 M, 29 R; 403/267, 268, 265

[56] References Cited

U.S. PATENT DOCUMENTS 2,837,381 6/1958 Sarlandt ..... 145/61 R
3,877,826 4/1975 Shepherd ..... 403/267

FOREIGN PATENT DOCUMENTS 5635 11/1979 European Pat. Off. ..... 145/29 R

*Primary Examiner*—James L. Jones, Jr.
*Attorney, Agent, or Firm*—Neil F. Markva

[57] ABSTRACT

A molded synthetic material tool handle comprises a synthetic material molded around an elongated reinforcing core. A tool carrying section is located at one end of the handle and a hand holding section extends from the tool carrying section. The tool carrying section includes a separator portion which is laterally spaced along the reinforcing core at a location between the end of the hand holding section and the free end of the core to form laterally spaced bonding material fill areas located on opposed sides of the separator portion. A sealing member is contiguously fit into a shoulder located at the end of the hand holding section. The sealing member acts as an expansion joint between the tool head and tool handle when connection is made with a high impact resin material.

17 Claims, 5 Drawing Figures

Fig. 1
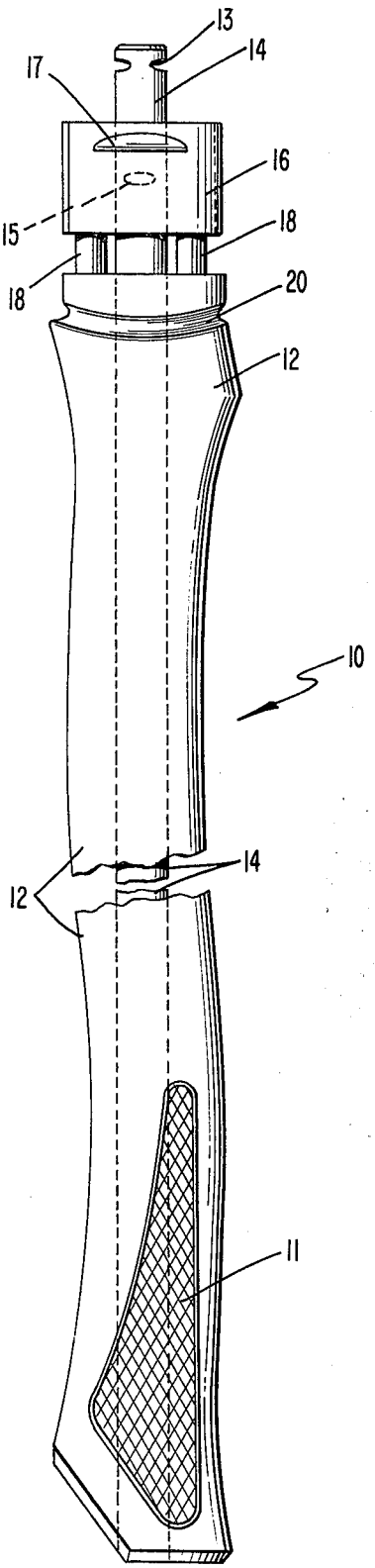
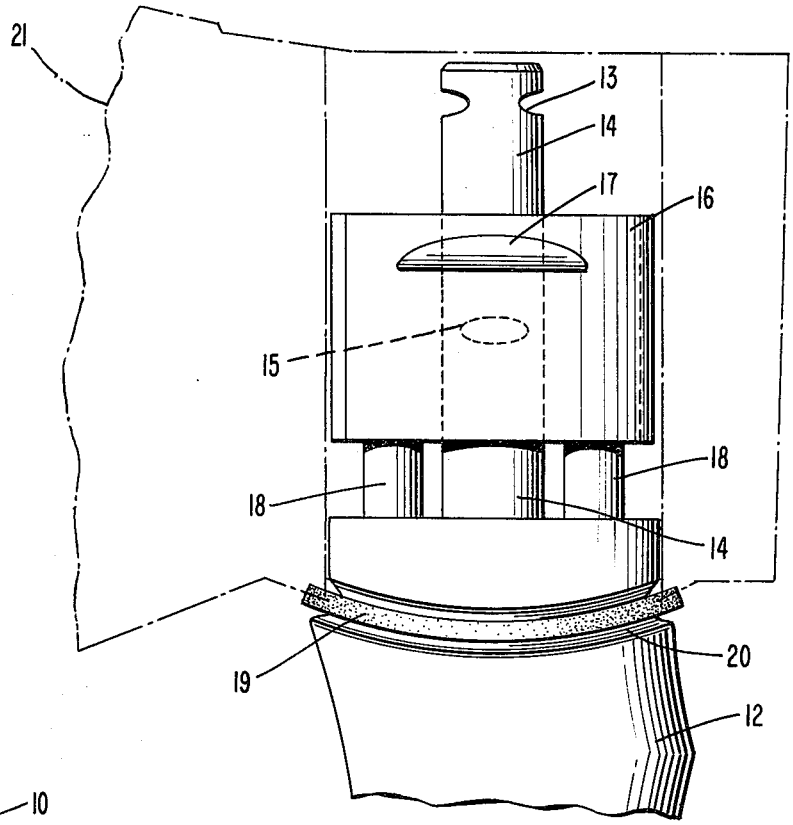
Fig. 2
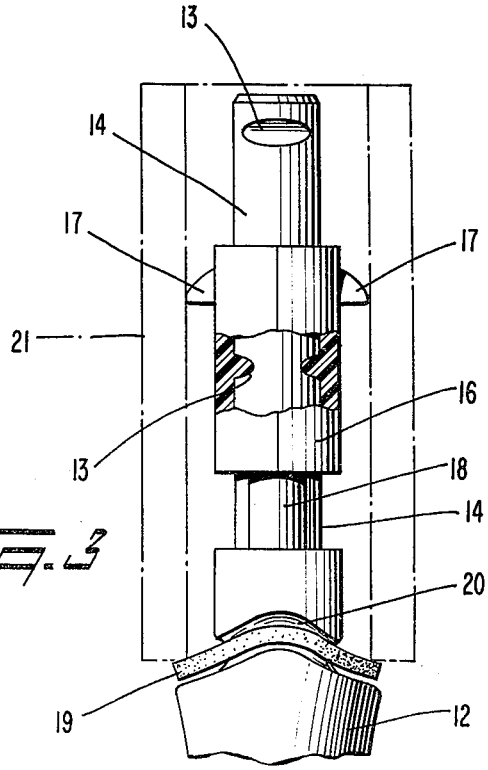
Fig. 3

HAND TOOL AND A CORE REINFORCED MOLDED SYNTHETIC MATERIAL HANDLE THEREFOR

FIELD OF THE INVENTION

This invention relates generally to hand tools such as axes, hammers, mallets, sledges and the like. More particularly, the invention relates to the specific structure of the tool handle and the manner in which the tool head is connected to the tool end section of the handle.

BACKGROUND OF THE INVENTION

The connecting of tool heads such as hammers, sledges, axes and the like is an old and well known art. With changes in the wood handles and the development of new handle materials, many new techniques have been used for bonding the tool head to the tool end section of the handle. Tool heads are generally cast metal implements. Thus, the eyehole for the tool head has varying size and shape tolerances.

Adhesives such as epoxy resins are commonly used to seal the wood tool handle tightly fitted to the tool head with a wedge. The adhesive partially seals the wood against moisture absorption, thereby reducing expansion in the wood. The use of specially molded shapes which require wedges to fix the tool or striking tool to the handle are known such as found in U.S. Pat. No. 3,779,296. This particular technique may also require the use of an adhesive. It is also known to use an adapter to attach tool heads to fiberglass tool handles. See particularly U.S. Pat. No. 4,030,847 and the patents specifically related thereto.

Most recently, tool handles having a molded plastic or synthetic material disposed around a rigid reinforcing rod have become commercially popular. Generally, the tool end section of such handles has been molded in the shape of the tool eyehole. See particularly the U.S. Pat. No. 3,770,033 and U.S. Pat. No. 2,837,381, each of which discloses a core reinforced molded synthetic material tool handle. A connection used in conjunction with a molded synthetic material tool handle is disclosed in U.S. Pat. No. 3,874,433. Here, the connection between a tool head and a handle composed of synthetic material includes the use of a bonding resin, an annular trim collar, and a separate metal filler. This particular type of connection, however, is not well suited to the specific type of core reinforced molded tool handle as described herein.

In another type of connection for the core reinforced molded tool handle, the core projects outwardly from the molded synthetic material and projects into the eyehole of the tool. The annular volume around the rigid core projection is then filled with epoxy resin. However, this prior art connection has proven unsatisfactory in actual use of the tool. In such a prior art structure, the handle begins to flex, that is, has freedom to expand and contract along the core. Thus, there is movement with respect to the tool and epoxy and fracturing of the epoxy occurs at the outer end or tip of the reinforcing core. It is believed that the resolution of forces in such a prior art connection involving the expansion and contraction of the handle on and along the core ultimately causes the failure of the epoxy resin bonding material.

Further structural characteristics of such a core reinforced molded plastic handle have caused fractures within the structure of the outer handle material at the connecting point between the tool head and the handle. For example, the molded plastic material necessarily expands and contracts under different atmospheric conditions. For example, if the handle is used in a warm atmosphere, the material expands. If the handle is then taken into a cold atmosphere, contraction of the molded outer coating results. Also, during use of the tool, the force of the blows and the swinging of the tool produces forces which cause the molded outer cover material to move with respect to the tool head. Such a relative movement will, in time, cause damaging cracks or fissures to form in the handle material.

SUMMARY OF THE INVENTION

The primary object of this invention is to produce a core reinforced molded synthetic material handle that will overcome the deficiencies of such known handles when connected to a tool head.

The tool handle of this invention includes a synthetic material molded around an elongated reinforcing core which has a free end. The synthetic material has an outer shape conforming to a handle designed for the specific tool to which it is to be connected. A tool carrying section is located at one end of the handle and a hand holding section extends from the tool carrying section. The tool carrying section includes a separator portion which is molded around the elongated reinforcing core and has a shaped outer surface. The separator portion is laterally spaced along the reinforcing core outwardly away from the hand holding section to form a bonding material fill area therebetween. The separator portion is located between the end of the hand holding section and the free end of the core so that the bonding material is located on opposed sides of the separator portion, thereby forming two separated force bearing areas on opposite sides of the separator portion. This disposition of the separated force bearing impact resistant bonding material is believed to prevent any rocking motion of the tool head once it is in place on the tool carrying end section of the handle. In any event, it has been found that this disposition of the separated bonding material fill areas on opposed sides of the separator portion has overcome and virtually eliminated the problem of fracturing within the tool head connection.

Another feature of the invention is directed to the use of means to mechanically interlock the separator portion with the rigid reinforcing core. The fixed separator portion is then connected to the hand holding section with molded synthetic material runners. This configuration allows for the necessary movement to exist between the molded synthetic material around the synthetic core within the hand holding section. An expansion joint is disposed between the tool head and the end of the hand holding section to maintain the suitable connection between the tool head and the handle. At the same time, the disposition of such an expansion joint compensates for the expansion and contraction movements for the molded synthetic material in the hand holding section. The material used to form the expansion joint is also effective to form a sealing component during the process used for connecting the tool head to the tool carrying end section of the handle.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is an elevational view of a tool handle made in accordance with this invention;

FIG. 2 is a fragmentary elevational view showing the detail of the connection between the tool head and the tool handle in accordance with this invention;

FIG. 3 is an elevational view 90° from the elevational view of FIG. 2 and partly in section;

DETAILED DESCRIPTION

Figure 4:
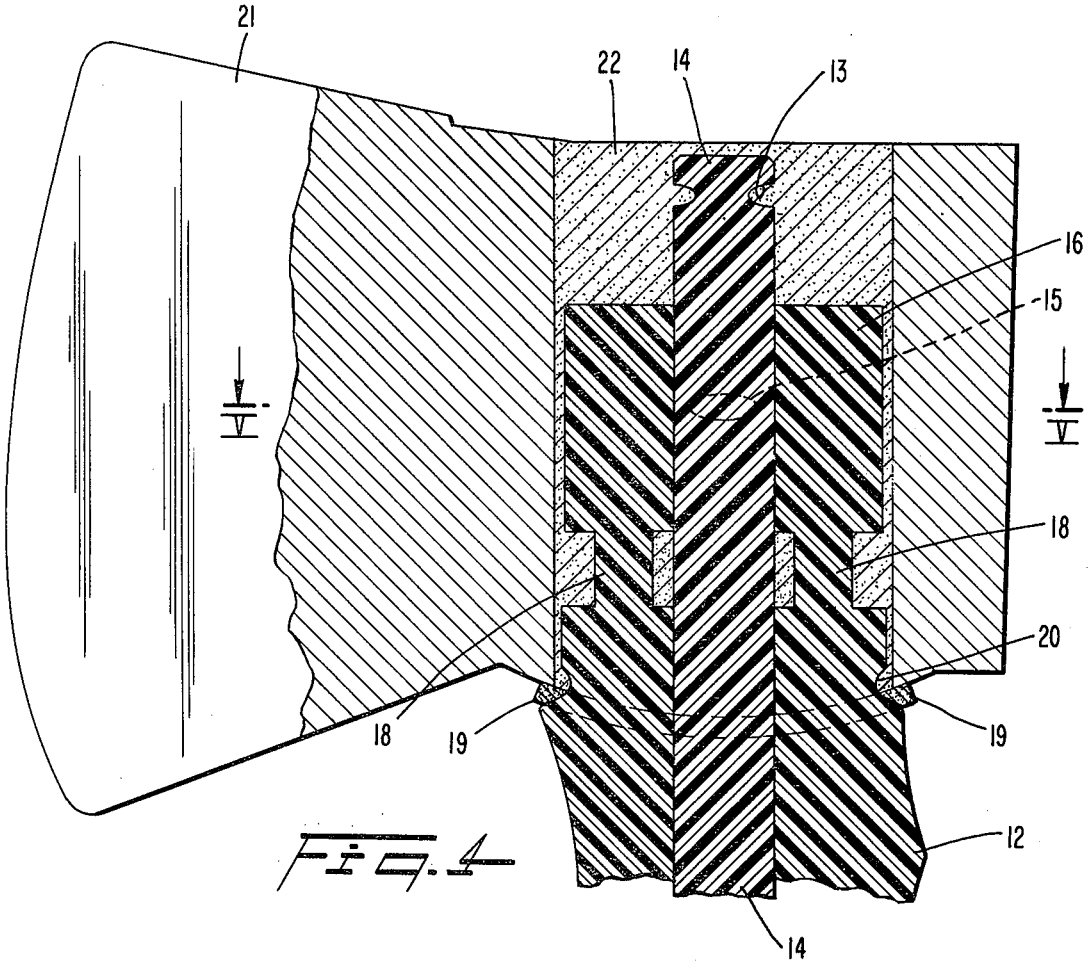
FIG. 4 is a cross-sectional view along the longitudinal axis of a hand tool made in accordance with this invention.

The tool handle, generally designated 10, includes a molded synthetic material hand holding portion 12 and an elongated reinforcing core 14. The hand holding portion 12 includes a gripping surface 11. The free end of the reinforcing core 14 is located in the tool carrying section at one end of the handle 10. The tool carrying section includes a separator portion 16 having a shaped outer surface and being laterally spaced along the reinforcing core 14 outwardly away from the end of the hand holding section 12. A notch 15 is formed in reinforcing core 14 at a location within molded separator portion 16. Thus, when the synthetic material flows into the mold during the molding operation, the notch 15 is filled with synthetic material and upon hardening forms a mechanical interlock between separator portion 16 and reinforcing core 14 within the tool carrying section of handle 10. Thus, when the hand holding section moves along the core through expansion and contraction, the hand holding section is thereby movable with respect to the fixed separator portion.

The tool carrying section also includes molded runners 18 which connect separator portion 16 to the end of hand holding section 12 of handle 10. Thus, separator portion 16 performs an anchoring function to keep the hand holding section 12 in position along core 14 during the time that the handle is not connected to the tool head. That is, it has been found important to have the molded synthetic material forming the hand holding section 12 to have the freedom for expansion and contraction. This is particularly important after the tool head 21 is connected to the tool carrying section.

The molded synthetic material includes a shoulder 20 located adjacent the end of hand holding section 12 and defines a sealing surface for the tool carrying section of handle 10. The sealing surface of shoulder 20 is effective to receive a sealing member 19 which fits contiguously thereto. In this particular embodiment, shoulder 20 is undercut, thereby aiding the holding of sealing gasket 19 in place and also forming a place for mechanical interlock to form when a high impact resistant resin is used during the connecting of the tool head 21 to handle 10.

Separator portion 16 includes locking tabs 17 which pfoject outwardly from opposite sides of the outer surface. As shown in FIG. 3, locking tabs 17 frictionally secure tool head 21 in position when the tool carrying section of handle 10 is inserted into the eyehole of tool head 21. Thus, tabs 17 effect the positioning of the tool head over the tool carrying section and will keep tension on gasket 19 while maintaining the tool head 21 in place during the subsequent bonding process.

Figure 5:
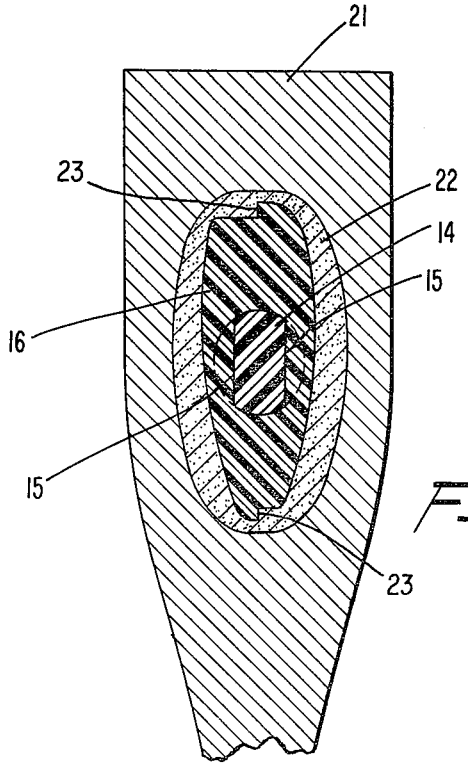
FIG. 5 is a fragmentary sectional view along line V—V of FIG. 4.

In this embodiment showing an axe handle, separator portion 16 is oblong shaped in cross section to fit in the eyehole of the axe tool head 21. Straight grooves 23 are located at the opposed ends of the major axis of the oblong cross section as clearly shown in FIG. 5. Thus, grooves 23 extend along the outer surface of the molded separator portion 16 and generally longitudinally with respect to the longitudinal axis of core 14.

The hand tool of this embodiment is formed by first placing gasket 19 into the shoulder 20. The tool carrying section of handle 10 is then inserted into the eyehole of axe tool head 21 as shown in FIGS. 2 and 3. In this embodiment, sealing gasket 19 is formed of a flexible ring of closed cell plastic foam. More specifically, the polyurethane foam ring is simply stamped out of a sheet of the closed cell foam material. The ring is oblong shaped and in one piece to simply fit directly into the shoulder 20 and contiguously with respect to the sealing surface for the tool carrying end section. Once the tool head 21 is firmly fixed in place over the tool carrying end of handle 10 with gasket 19 disposed therebetween, a liquid bonding resin is poured into the top of the eyehole. The area completely around separator portion 16 is completely filled with bonding material. Most specifically, the disposition of separator portion 16 located between the end of the hand holding section 12 and the free end of core 14 forms laterally spaced bonding material fill areas located on opposite sides of separator portion 16. In this embodiment, high impact resistant resin is heated to about 120° F. and mixed by machine and poured into the eyehole which is sealed at the joint between the tool head 21 and shoulder 20 by gasket 19. The gasket 19 prevents any of the liquid resin from flowing outwardly from the eyehole.

The impact resistant resin 22 has a first bonding material fill area in the space between separator portion 16 and the end of hand holding section 12. Runners 18 are located in the first bonding fill area. A second bonding material fill area surrounds the free end of core 14 and has a mechanical interlock with notches 13. Separator portion 16 is radially dimensioned outwardly from the longitudinal axis of core 14 to form a third bonding material fill area over the shaped outer surface of portion 16.

Straight grooves 23 along the separator portion 16 facilitate the filling of the bonding material fill area between the end of the hand holding section 12 and the separator portion 16 as shown. The notches 13 in core 14 are also filled. Upon hardening, the mechanical interlock is formed at the notches 13 upon the hardening of the impact resistant resin within the eyehole of tool head 21. In this embodiment, the impact resin is a two-part epoxy resin known as Hardman No. 7982. Furthermore, in this embodiment, the bonding material 22 completely fills the area around separator portion 16 when the tool carrying section is disposed in the eyehole of tool head 21. However, it is clear that the basic function of separator portion 16 is to form separate bearing areas formed by bonding material 22 on opposed sides of the separator portion 16 as shown. Thus, there is a completely different resolution of forces effected than has previously been achieved when the eyehole has been completely filled with bonding material such as has been used in the prior art. The specific disposition of the separate bonding areas on either side of separator portion 16 has eliminated the cracking problem experienced in the bonding material of the prior art procedure.

It is theorized that separator block 16 enables the handle to be maintained in an assembled fashion. Consequently, if the plastic of the coating molded around the reinforcing core 14 tends to walk along core 14, runners 18 may simply fracture. This allows the plastic to move back onto the handle 10, that is, to move toward the hand holding section. In such an event, the gasket or sealing ring 19 simply tends to open up and takes up any gap which may occur. Thus, an expansion joint is made an integral part of the hand tool of the present invention.

This is particularly helpful when the gasket 19 is made up of a closed cell foam material such as polyurethane foam which will be able to expand and contract as the molded material of the hand holding portion 12 moves along core 15. Further, if forces acting upon the head causes the tool head 21 to move outwardly from core 14, the same expansion function is experienced by the gasket or sealing member 19. Thus, the expansion joint expands and contracts as the molded synthetic material moves with respect to tool head 21.

In this particular embodiment, the synthetic material used to form the hand holding portion 12 is polypropylene. Various other structural foam materials may also be used. The molding of polypropylene around a rigid reinforcing core is extremely old and well known. However, until now, the specific use of such a structural form around a core has not been satisfactory because of the inability to adequately bond the tool head to the tool carrying end section of the handle. There is constant flexing and impact forces which attack the connection between the tool head and the handle. With the connection technique and specific structure of the tool end section as set forth herein, the objections and disadvantages associated with prior art handles of this type have been overcome.

While the Hand Tool and Core Reinforced Molded Synthetic Material Handle Therefor has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A molded synthetic tool handle comprising:

(a) a synthetic material molded around an elongated reinforcing core which has a free end, (b) said synthetic material having an outer shape conforming to a handle designed for the specific tool for which it is to be used, (c) said molded synthetic material forming a tool carrying section at one end of the handle and a hand holding section extending from the tool carrying section, (d) said tool carrying section including a separator portion having a shaped outer surface and being longitudinally spaced along the reinforcing core at a location between the end of the hand holding section and the free end of the core to form laterally spaced bonding material fill areas located on opposed sides of the separator portion, (e) said tool carrying section including means to mechanically interlock the molded synthetic material of the separator portion with the rigid, reinforcing core, (f) said hand holding section being free of any additional mechanical interlock relative to the core adjacent the separator portion thereby having freedom for expansion and contraction along the core and thereby being movable with respect to the separator portion.

2. A handle as defined in claim 1 wherein said mechanically interlock means are disposed on said core.

3. A handle as defined in claim 1 wherein said tool carrying section includes molded runner means which connects the separator portion to said end of the hand holding section.

4. A handle as defined in claim 3 wherein said runner means includes two runner members having longitudinal axes disposed parallel to the longitudinal axis of the reinforcing core.

5. A handle as defined in claim 1 wherein said molded synthetic material includes shoulder means adjacent said end of the hand holding section and defining a sealing surface for the tool carrying section.

6. A handle as defined in claim 1 wherein said sealing surface is effective to receive solid sealing means to fit contiguously thereto.

7. A handle as defined in claim 1 wherein said molded separator portion includes locking tabs which project outwardly from opposite sides of said outer surface to frictionally secure a tool in position when the tool carrying section is inserted into an eyehole of the tool.

8. A handle as defined in claim 1 wherein said mechanically interlock means includes a notch formed in the reinforcing core at a location within the molded separated portion to cause the synthetic material to flow therein during the molding operation.

9. A handle as defined in claim 1 wherein said outer shape of the hand holding section is conformed to an axe handle, and said separator portion is oblong-shaped in cross section to fit in an eyehole of an axe head.

10. A handle as defined in claim 1 wherein said molded separator portion includes straight grooves extending along said outer surface and generally longitudinally with respect to the core axis, said grooves being effective to allow flowable bonding material to pass between the separator portion and the inside surface of an eyehole of a tool head.

11. A handle as defined in claim 1 wherein said molded synthetic material includes shoulder means adjacent said end of the hand holding section and defining a sealing surface for the tool carrying end section, said shoulder means is undercut to be filled with liquid bonding material forming a mechanical interlock upon hardening of the bonding material.

12. A handle as defined in claim 1 wherein said bonding material is an impact resistant resin, and said tool carrying section includes means to mechanically interlock the impact resistant resin with the rigid reinforcing core within the eyehole of a tool head.

13. A hand tool comprising:

(a) a tool head having an eyehole and a molded synthetic material tool handle, (b) said tool handle including an elongated reinforcing core which has a free end, (c) said synthetic material having an outer shape conforming to a handle designed for the specific tool for which it is to be used, (d) said molded synthetic material forming a tool carrying section at one end of the handle and a hand holding section extending from the tool carrying section, (e) said molded synthetic material includes shoulder means adjacent said end of the hand holding section and defining a sealing surface for the tool carrying end section, (f) sealing means disposed on the sealing surface between the handle and tool head, and (g) a bonding material including an impact resistant resin disposed within the eyehole of the tool head, (h) said tool carrying section including a separator portion having a shaped outer surface and being longitudinally spaced along the reinforcing core at a location between the end of the hand holding section and the free end of the core to form laterally spaced bonding material fill area located on opposed sides of the separator portion, (i) said tool carrying section including means to mechanically interlock the molded synthetic material of the separator portion with the rigid, reinforcing core, (j) said hand holding section being free of any additional mechanical interlock relative to the core adjacent the separator portion thereby having freedom for expansion and contraction along the core and thereby being movable with respect to the separator portion.

14. A hand tool as defined in claim 13 wherein said sealing means forms an expansion joint which expands and contracts as the molded synthetic material moves with respect to the tool head.

15. A hand tool as defined in claim 14 wherein said sealing means comprises a flexible, ring of closed cell plastic foam.

16. A hand tool as defined in claim 15 wherein said closed cell foam comprises a polyurethane foam sheet ring.

17. A hand tool as defined in claim 12 wherein the tool head is an axe and the outer shape of the hand holding portion is conformed to an axe handle.

* * * * *